US007690636B2

(12) United States Patent
Noh

(10) Patent No.: US 7,690,636 B2
(45) Date of Patent: Apr. 6, 2010

(54) FINISHING APPARATUS IN COPYING MACHINE

(75) Inventor: Seung-Kyoon Noh, Seoul (KR)

(73) Assignees: KRDC Co., Ltd., Seoul (KR); Gradco Ltd., Tokyo (JP)

( * ) Notice: Subject to any disclaimer, the term of this patent is extended or adjusted under 35 U.S.C. 154(b) by 1351 days.

(21) Appl. No.: 10/499,001

(22) PCT Filed: Aug. 5, 2002

(86) PCT No.: PCT/KR02/01477

§ 371 (c)(1),
(2), (4) Date: Apr. 22, 2005

(87) PCT Pub. No.: WO03/056395

PCT Pub. Date: Jul. 10, 2003

(65) Prior Publication Data

US 2005/0231743 A1 Oct. 20, 2005

(30) Foreign Application Priority Data

Dec. 24, 2001 (KR) ..... 2001-84197

(51) Int. Cl.
*B65H 37/04* (2006.01)

(52) U.S. Cl. ..... 270/58.12; 270/58.07; 270/58.08; 270/58.11; 270/58.13; 270/58.17

(58) Field of Classification Search ..... 270/58.07, 270/58.08, 58.11, 58.12, 58.13, 58.17
See application file for complete search history.

(56) References Cited

U.S. PATENT DOCUMENTS 5,098,074 A * 3/1992 Mandel et al. ..... 270/58.13
5,639,079 A * 6/1997 Suzuki et al. ..... 270/58.17
5,911,414 A * 6/1999 Kato et al. ..... 270/58.07
5,964,459 A * 10/1999 Yamanaka ..... 270/58.08
6,145,826 A * 11/2000 Kawata ..... 270/58.28
6,290,220 B1 * 9/2001 Takehara et al. ..... 270/58.12
6,330,999 B2 * 12/2001 Coombs et al. ..... 270/58.18
6,416,052 B2 * 7/2002 Yamada et al. ..... 271/292
2003/0193125 A1 * 10/2003 Saegusa et al. ..... 270/58.08
2004/0212134 A1 * 10/2004 Kaneko ..... 270/32
2006/0017210 A1 * 1/2006 Sato et al. ..... 270/58.08

FOREIGN PATENT DOCUMENTS

| | | |
|---|---|---|
| JP | 63-171724 | 7/1988 |
| JP | 11-236160 | 8/1999 |
| KR | 1992-0008754 | 10/1992 |
| KR | 1996-0006811 | 5/1996 |

* cited by examiner

*Primary Examiner*—Gene Crawford
*Assistant Examiner*—Leslie A Nicholson, III
(74) *Attorney, Agent, or Firm*—Greenblum & Bernstein, P.L.C.

(57) ABSTRACT

A finishing apparatus in a copying machine is disclosed, which can finish large sized papers without enlarging the size of a tray base. The finishing apparatus includes a jogging assembly 170 aligning papers in left and right directions, a paper contact plate 166 provided with a stapler 196, a paper roller 200 pushing the papers to a paper stacker 134, ends of the papers being positioned in the stapler, a tray base 10 moving in a direction opposite to the paper roller to guide alignment of a set of the papers, and an angle adjusting unit guiding the papers by adjusting a tilt angle of the papers in accordance with the size of the papers.

17 Claims, 11 Drawing Sheets

FINISHING APPARATUS IN COPYING MACHINE

TECHNICAL FIELD

The present invention relates to a copying machine or printer having a finishing apparatus provided with a paper stacker and a tray unit, and more particularly to a tray unit that finishes papers printed by a copying machine and moves the finished papers to a paper stacker.

BACKGROUND ART

Papers finished by a copying machine or printer are temporarily stacked onto a tray unit for finishing processes such as stapling and booklet and then move to a paper stacker through a series of processes.

The papers stacked onto the paper stacker are aligned depending on contact with papers moved from the tray unit or distance between the paper stacker and the tray unit.

One example of a related art finishing apparatus in a copying machine is disclosed in the Japanese Patent Publication No. 4-316894.

A structure of a copying machine having a related art finishing apparatus will be described with reference to FIGS. 1 to 3.

FIG. 1 is a sectional view illustrating an outlet of a copying machine having a related art finishing apparatus. FIGS. 2*a* and 2*b* are sectional views illustrating the operation of the related art tray unit. FIG. 3 is a plane view of the related art tray unit.

A housing 15 of a related art finishing apparatus 12 is detachably provided in a copying machine 11. That is, the housing 15 of the finishing apparatus 12 can be detached from the copying machine 11 by a fixed portion 16.

The finishing apparatus 12 may be provided in the copying machine 11 to form a single body without being detached from the main body of the copying machine 11. The finishing apparatus 12 is connected with the copying machine 11 through a path network 18.

The path network 18 includes paper paths 20 and 21 having a roller 22 and a deflector 24.

The roller 22 and the deflector 24 are driven by a driving part 25. An outlet 28 is formed by the roller 22 and ejects papers through the paper path 20 or 21.

The paper paths 20 and 21 move the papers to an upper paper stacker 32 and a lower paper stacker, respectively.

At the outlet of the paper path 21, a rolling wheel 36 and a waveform roller 38 are provided along with the roller 22. The roller 22 has an arc shaped waveform to facilitate ejection of the papers at a proper speed. The rolling wheel 36 and the waveform roller 38 act to push the papers from the outlet.

The upper paper stacker 32 is fixed to the housing 15 while the lower paper stacker 34 is supported by an elevator assembly 44 and is linked to a side shift plate 45.

The paper stackers 32 and 34 are tilted to have a predetermined angle and allow a set of respective papers or stapled papers to be easily stacked thereon.

The elevator assembly 44 includes a truck 51, a cable 52 wound in a pair of pulleys 54, and an elevator support member 48.

The elevator support member 48 is slidably connected with the truck 51 and moves up and down in response to movement of the cable 52.

The pulley 54 is driven by an elevator motor 56, and the elevator motor 56 and the driving part 25 are programmably controlled by a controller 58.

Meanwhile, a tray base 10 is slidably fixed to a pair of support rails 62. The support rails 62 are fixed to both sides of the housing 15 but one support rail 62 is shown in a sectional structure of FIG. 1.

The tray base 10, as shown in FIG. 3, is formed of a rectangular shaped plate of metal or plastic, and a channel 69 is provided in a movement base in parallel with a moving direction of the papers.

The tray base 10 includes one or more paper contact plates 66 provided to form a single body with the corner of the tray unit, and a positioning unit having a side plate 68.

The positioning unit is provided with a jogging assembly 70. A wheel 2 connected with a shaft 73 is provided in the jogging assembly 70.

The wheel 72 is parallel with the surface of the tray base 10 and forms an acute angle with the plane of the side plate 68.

The shaft 73 is connected with a motor 74 which is connected with the controller, and the motor 74 drives the wheel 72.

Furthermore, when the stapled papers are input and output, a sensor 76 is provided below the tray base 10 to sense the height of the lower paper stacker 34.

The sensor 76 includes a paper clamp unit 77 and a switch 78. The switch 78 is connected with the controller 58.

The clamp unit 77 is bound into a predetermined arc and moves between the first part triggering the position of an open switch and the second part triggering the position of a closed switch.

Meanwhile, as shown in FIG. 1, the tray base is provided in such a manner that a reciprocating mechanism 80 elastically supported by a spring is connected with the finishing apparatus 12.

The reciprocating mechanism 80 is provided with a rotatable cam follower 82 which is connected to the rear of the tray base 10. The cam follower 82 is elastically supported by a spring 88 and is driven by a cam 90.

The cam 90 is fixed to a shaft 92 which is controlled by a motor 94. The motor 94 is connected with the controller 58.

The aforementioned reciprocating mechanism 80 can reciprocate the cam follower 82 and the tray base 10 when the cam 90 rotates along with the shaft 92 because the shaft 92 is eccentric with respect to the circumference of the cam 90.

The structure of the related art finishing apparatus will be described in more detail with reference to FIGS. 2*a* and 2*b*.

A general stapler that staples papers is denoted by a reference numeral 96.

The stapler 96 is arranged to staple the corner of papers.

A base (anvil) having a sufficient area is provided so that a set of papers are not scattered during or before stapling operation when the papers are set between a core of the stapler 96 and the tray base 10.

The stapler 96 is provided at the rear of the tray base 10 and reciprocates along with the tray base 10.

Since the paper contact plate 66 is matched with and fitted into a channel 69, the paper contact plate 66 freely moves in the channel 69 when the tray base 10 is retracted.

The stapled papers can be extruded from the tray base 10 using a paper roller 100.

A driving gear 106 elastically supported by a spring is connected with the rear of the paper roller 100. The driving gear 106 has a structure similar to that of the reciprocating mechanism 80.

The driving gear 106 is provided with a cam follower 110. The cam follower 110 is elastically supported by a spring 112.

A cam 114 is fixed to the shaft 92 and reciprocates the cam follower 110 when the cam 90 reciprocates the cam follower 82.

The cams 90 and 114 are provided in such a manner that the front end of the tray base 10 is retracted to the front corner of the housing 15 or the end of the paper roller 100 moves to the front corner of the housing 15.

The operation of the aforementioned related art finishing apparatus will now be described.

Copying papers are fed to the deflector 24 arranged at a branch of the paper paths 20 and 21. If the papers are directly ejected without stapling operation, the deflector 24 conveys the papers to the upper moving path 20 using the driving part 25 and the controller 58. If the finishing process such as stapling is performed, the papers move to the lower moving path 21 using the driving part 25 and the controller 58.

If the printed papers are ejected from the end of the outlet of the lower paper path 21, the papers are arranged on both the lower paper stacker 34 and the tray base 10.

In other words, the first part of the papers is arranged on the lower paper stacker 34 while the second part is arranged on the tray base 10.

Since the paper stacker and the tray base are tilted at a predetermined angle, the second part of the papers arranged on the tray base is slid toward the rear of the tray base 10 by means of gravity and paper positioning is made in a moving direction of the papers by means of the paper contact plate 66.

At this time, the jogging wheel 72 rotates as the motor 74 is driven by a signal of the controller 58. The corners of the papers moved by the jogging operation of the wheel 72 are pushed to the corners defined by the paper contact plate 66 and the side plate 68.

Therefore, positioning of the papers is made in such a manner that the corners of the papers are perpendicular to the moving direction of the papers.

The waveform roller 38 and the rolling wheel 36 serve to control the speed of the papers when the papers are ejected from the paper path 21 and align the papers so as to prevent the papers from being scattered.

The positioned papers are stapled by the stapler 96 arranged at the corner.

Subsequently, the driving gear 106 operates as the motor 94 is driven through the controller, so that the paper roller 100 advances through the channel 69. The tray base 10 is retracted by the reciprocating mechanism 80 so that the stapled papers are ejected to the paper stacker 34.

If the paper roller 100 advances, the end of the paper roller 100 is in contact with the second part (lower part) of the stapled papers so as to push the contact part to the paper stacker 34 and at the same time move the tray base 10 and the papers in an opposite direction. Also, since the sensor 76 is retracted along with the tray base 10, the clamp unit 77 rotates from the first part to the second part, thereby moving the switch 78 to the open position.

When the corner at the rear of the stapled papers reaches the corner at the front of the housing 15, the papers are dropped onto the lower paper stacker 34.

Before the stapled papers are ejected from the tray base 10, the controller 58 transmits the signal received from the motor 94 to the elevator motor 56 and drops an elevator support member 48 by a predetermined distance.

The drop distance of the paper stacker is maintained within the range that the papers stacked onto the paper stacker 34 do not interfere drop of the next papers.

If the papers subjected to the finishing process such as stapling are ejected onto the paper stacker, the tray base 10 returns to the original position of FIG. 2*a*.

Once the tray base 10 returns to the original position, the paper stacker 34 connected with the elevator support member 48 starts to ascend by means of action of the truck 51.

The paper stacker 34 is shifted to the side by action of the side shift plate 45 before ascending operation. That is, the paper stacker 34 is disposed in the side by the side shift plate so that the stapled papers are stacked onto the paper stacker in a zigzag pattern, thereby facilitating distribution and disposal of the papers.

If the paper stacker 34 continues to ascend, the upper part of the papers stacked onto the paper stacker 34 is in contact with the clamp unit 77. The clamp unit 77 is pushed upwardly to turn off the switch 78.

Once the switch 78 is turned off, the signal is transmitted to the controller 58. The controller 58 transmits the signal to the elevator motor 56 to stop movement of the elevator support member 48.

However, the aforementioned related art finishing apparatus has several problems.

The distance between the tray base 10 and the paper stacker 34 is uniformly maintained regardless of the movement of the tray base 10 to the paper stacker 34, i.e., the front end of the housing 15 or the rear end of the housing 15. In this case, it is difficult to facilitate the finishing process of large sized papers.

The problems of the related art finishing apparatus will be described in more detail with reference to FIGS. 4 and 5.

If the papers are ejected through the paper path in a state where the tray base 10 of the tray unit is completely extended to the paper stacker 34, the tray base 10 guides the papers to the paper contact plate 66.

As shown in FIG. 4, if small sized papers 13 are provided, the papers are guided to the paper contact plate 66 in a state where the first and second part A and B of the papers are stably supported by the tray base 10. However, if large sized papers 13 are provided as shown in FIG. 5, the first part A of the papers ejected through the paper path is arranged on the paper stacker 34 and the second part B of the papers is arranged on the tray base 10.

If the papers are arranged on the paper stacker and the tray base as shown in FIG. 5, in the structure of the related art tray unit, fold "C" of the papers occurs at the outer end of the tray base 10. Such fold prevents the papers from being smoothly slid to the paper contact plate 66.

The large sized papers may be slid to the paper contact plate without fold by increasing the extension length of the tray base 10. However, in this case, problems arise in that the volume of the apparatus increases and reciprocating time of the tray base increases, thereby reducing efficiency of the apparatus.

In other words, the related art finishing apparatus has problems in that the finishing process of various sized papers, especially large sized papers cannot be performed with the small volume of the apparatus.

DISCLOSURE OF THE INVENTION

Accordingly, the present invention is directed to a finishing apparatus in a copying machine that substantially obviate one or more of the problems due to limitations and disadvantages of the related art.

An object of the present invention is to provide a finishing apparatus in a copying machine that smoothly guides large sized papers to a paper contact plate and improves the state of papers to be stacked onto a paper stacker.

Another object of the present invention is to provide a finishing apparatus in a copying machine that can finish large sized papers without enlarging the size of a tray base.

Other object of the present invention is to provide a finishing apparatus in a copying machine that can improve finishing efficiency of papers by reducing the size of a tray base.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a finishing apparatus in a copying machine according to the present invention is characterized in that small sized papers are smoothly guided to a contact plate by tilting a tray base while large sized papers are guided to the contact plate by reducing an angle of the tray base to make the distance between a paper stacker and the tray base narrow and not to allow the papers arranged in the paper stacker and the tray unit to be folded.

To further achieve these and other advantages and in accordance with the purpose of the present invention, a finishing apparatus in a copying machine according to the present invention includes a jogging assembly 170 aligning papers in left and right directions, at least one stapler 196 and a paper contact plate 166, a paper roller 200 pushing the papers to a paper stacker 134, ends of the papers being positioned in the stapler, a tray base 10 moving in a direction opposite to the paper roller to guide alignment of a set of the papers, and an angle adjusting unit guiding the papers by adjusting the angle of the tray base in accordance with the size of the papers.

The angle adjustment of the tray base is made by a recess groove 131 formed at a predetermined position (a rotary shaft supporting the tray base) on the tray base moving along a support roller 130 to recess the support roller.

In other words, if the tray base movably supported on the support roller moves to the paper stacker 134 and is recessed in the recess groove 131 formed in the tray base, the outer end at the front of the tray base is dropped by a predetermined distance.

As described above, since the angle adjustment of the tray base guiding alignment of a set of the papers is made while moving in a direction opposite to the paper roller, when the large sized papers are guided to the contact plate, the papers are slid to the contact plate by reducing the angle of the tray base to allow the surfaces of the papers arranged in the paper stacker 134 and the tray unit 160 not to be folded. When the small sized papers are guided to the contact plate, the papers are slid to the contact plate by tilting the tray base.

The tray base 10 has one end connected with one end of a rotational link 210 and the other end of the rotational link is fixed to a fixed shaft 150 to reciprocate the rotational link along the contact plate 166. The other end of the rotational link is provided with a gear 125 to form a single body with the rotational link, and the gear 125 is engaged with a driving motor gear 110 to rotate the rotational link.

Meanwhile, when the papers are guided to the paper contact plate or the finished papers are stacked onto the paper stacker 134 by pushing them from the paper contact plate 166, the clamp unit 177 is linked to the rotational link 210 so as to prevent the papers from being scattered.

The clamp unit 177 pushes the papers stacked onto the paper stacker and is detached from the end of the papers to the paper contact plate when the finished papers are dropped onto the paper stacker 134, i.e., at a position where the tray base 10 is completely retracted.

If the tray base moves outwardly to guide the papers moving for the finishing process through a paper path network, the clamp unit 177 moves together to push the end of the papers stacked onto the paper stacker.

The paper path network is provided with a rolling wheel 136 to align the papers.

The finishing apparatus in a copying machine according to the present invention is provided with the related art elements such as an elevator assembly and a shaft shift plate to move up and down and enable eccentric movement of the paper stacker.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
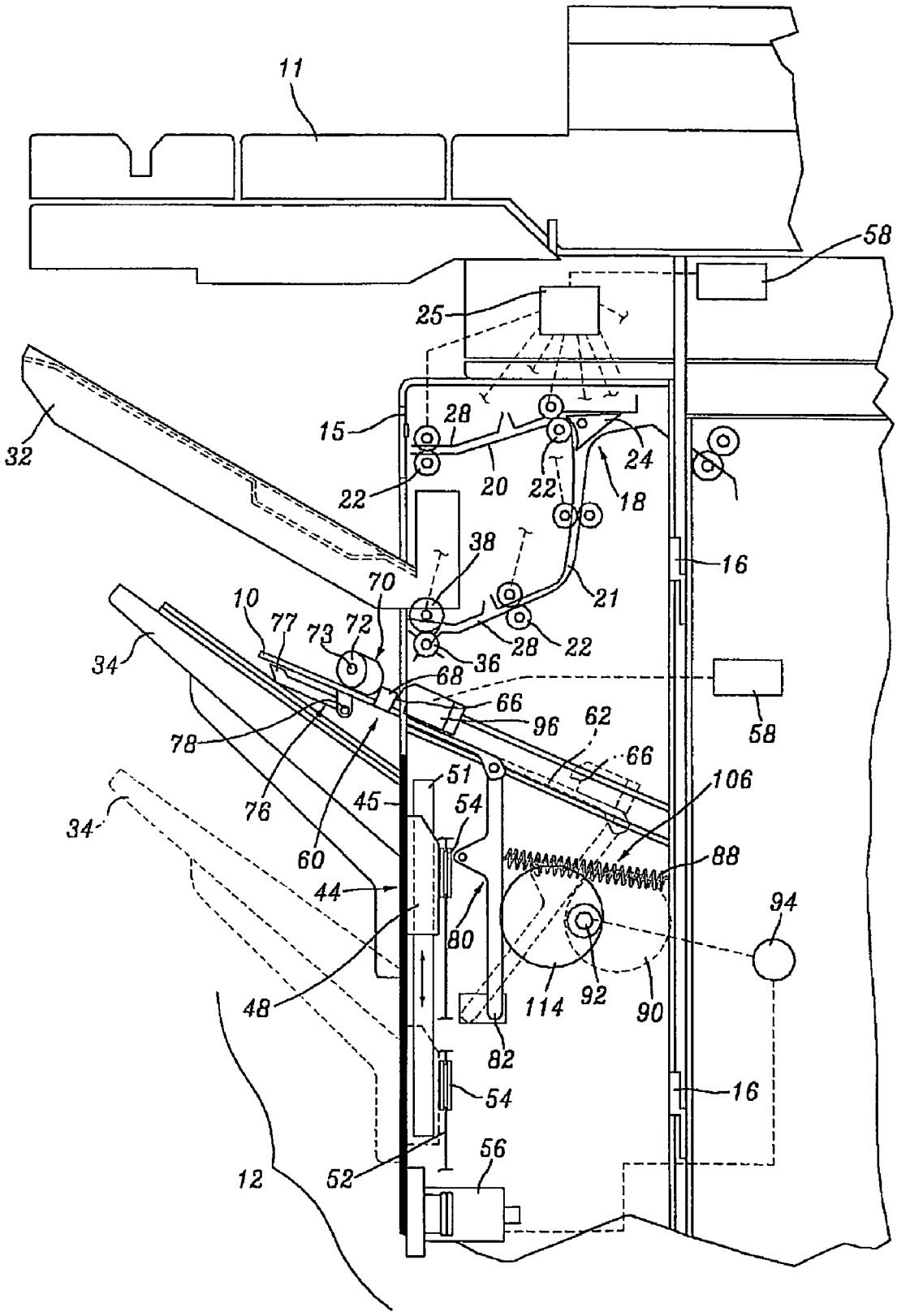
FIG. 1 is a sectional view illustrating a copying machine having a related art finishing apparatus.
Figure 2A:
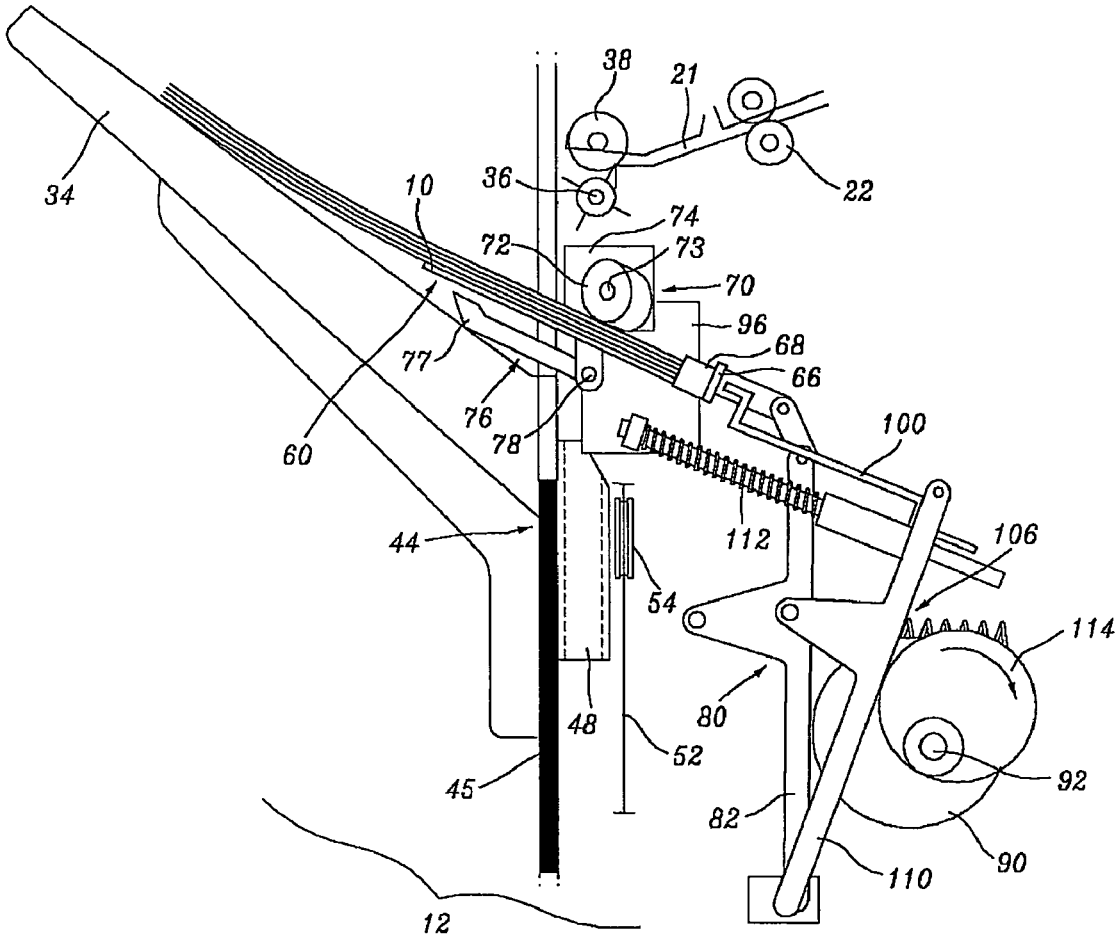
FIGS. 2*a* and 2*b* are partial sectional views illustrating the operation of the related art finishing apparatus.
Figure 2B:
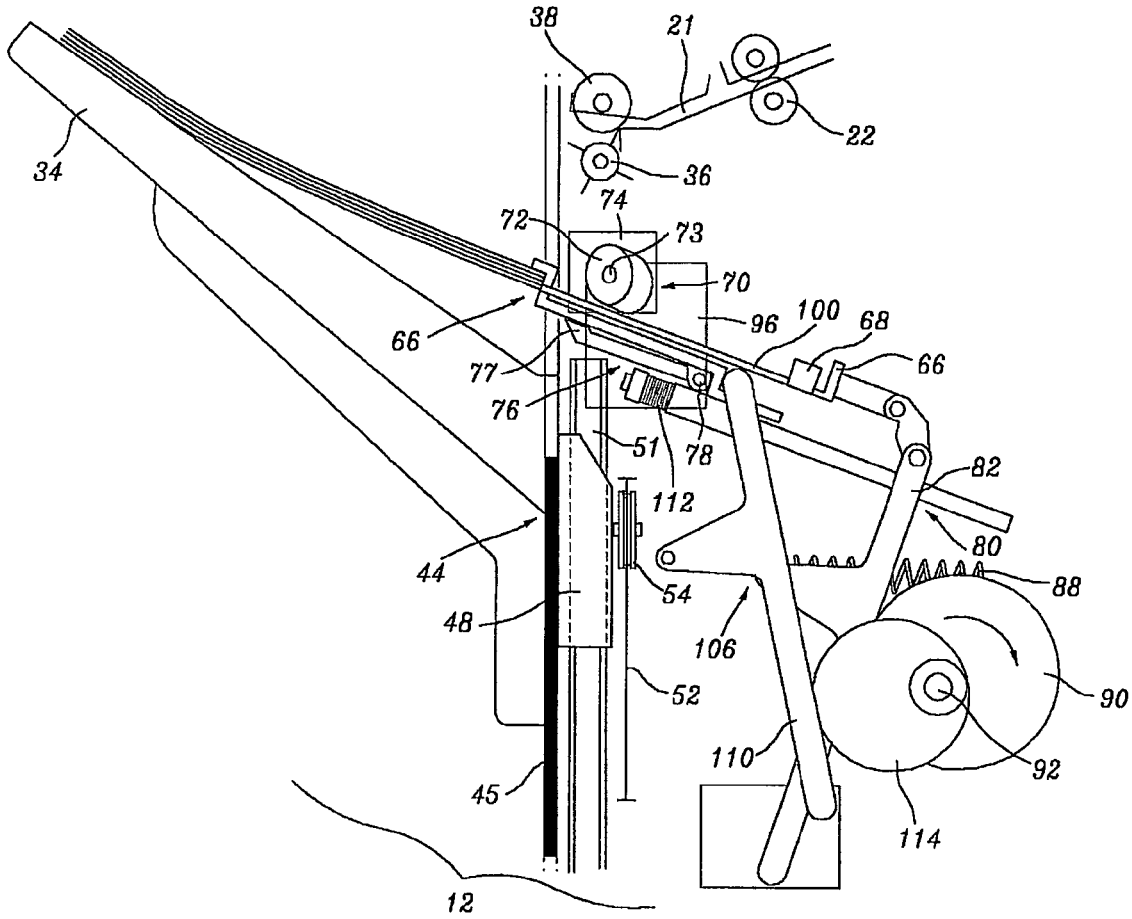
Figure 3:
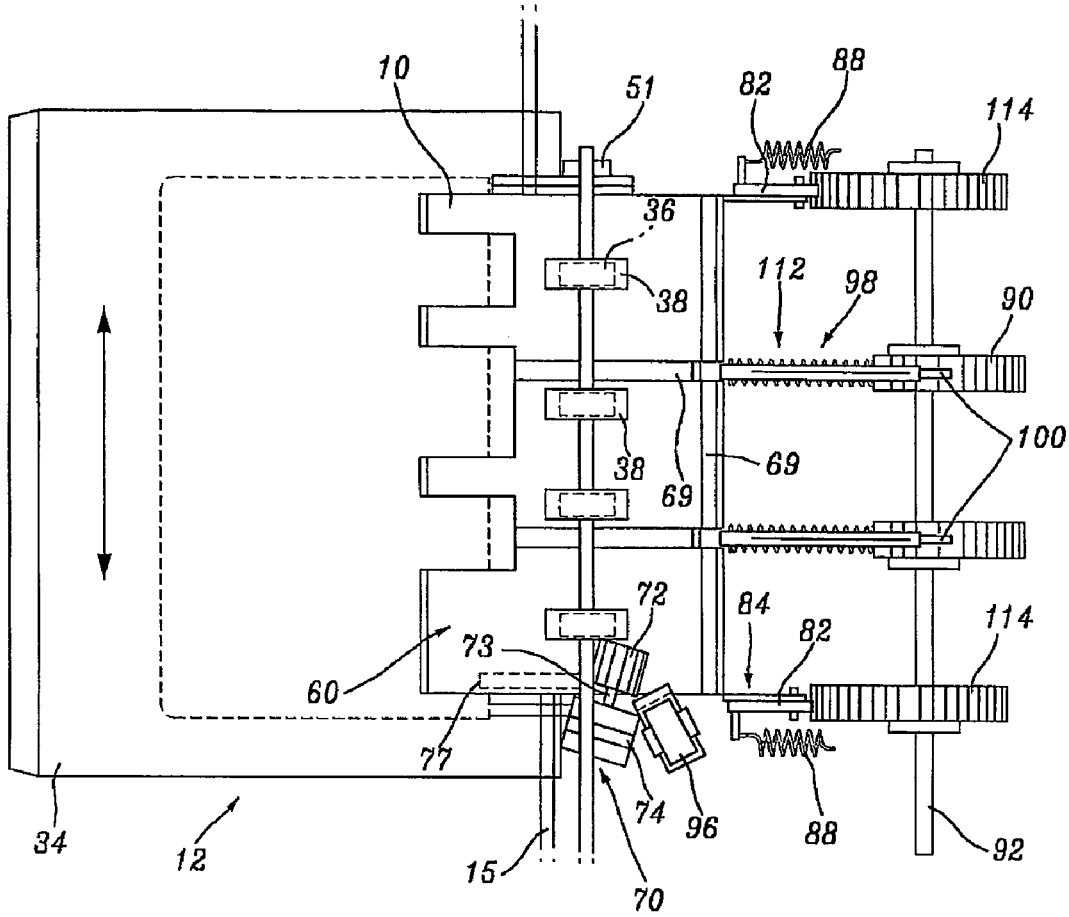
FIG. 3 is a plane view of the related art finishing apparatus.
Figure 4:
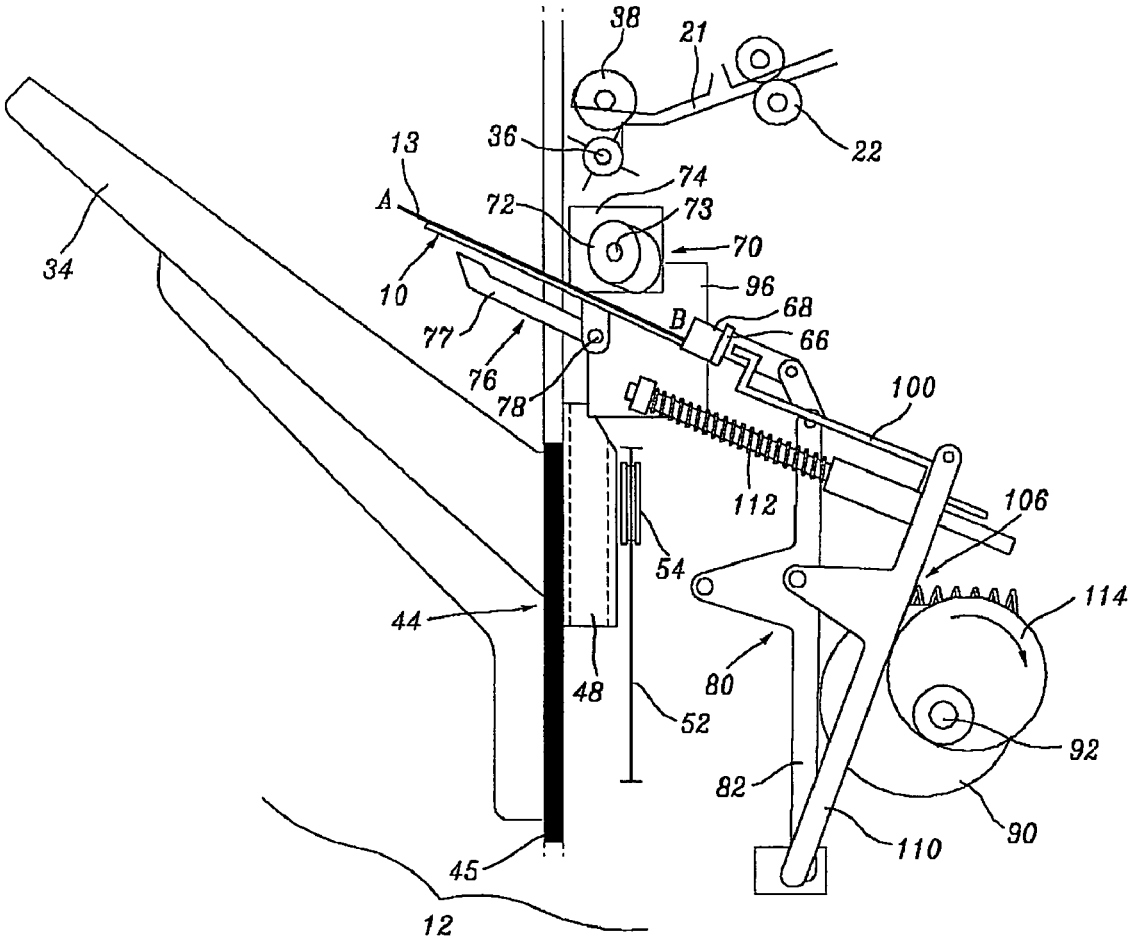
FIGS. 4 and 5 are sectional views illustrating problems of the related art finishing apparatus.
Figure 5:
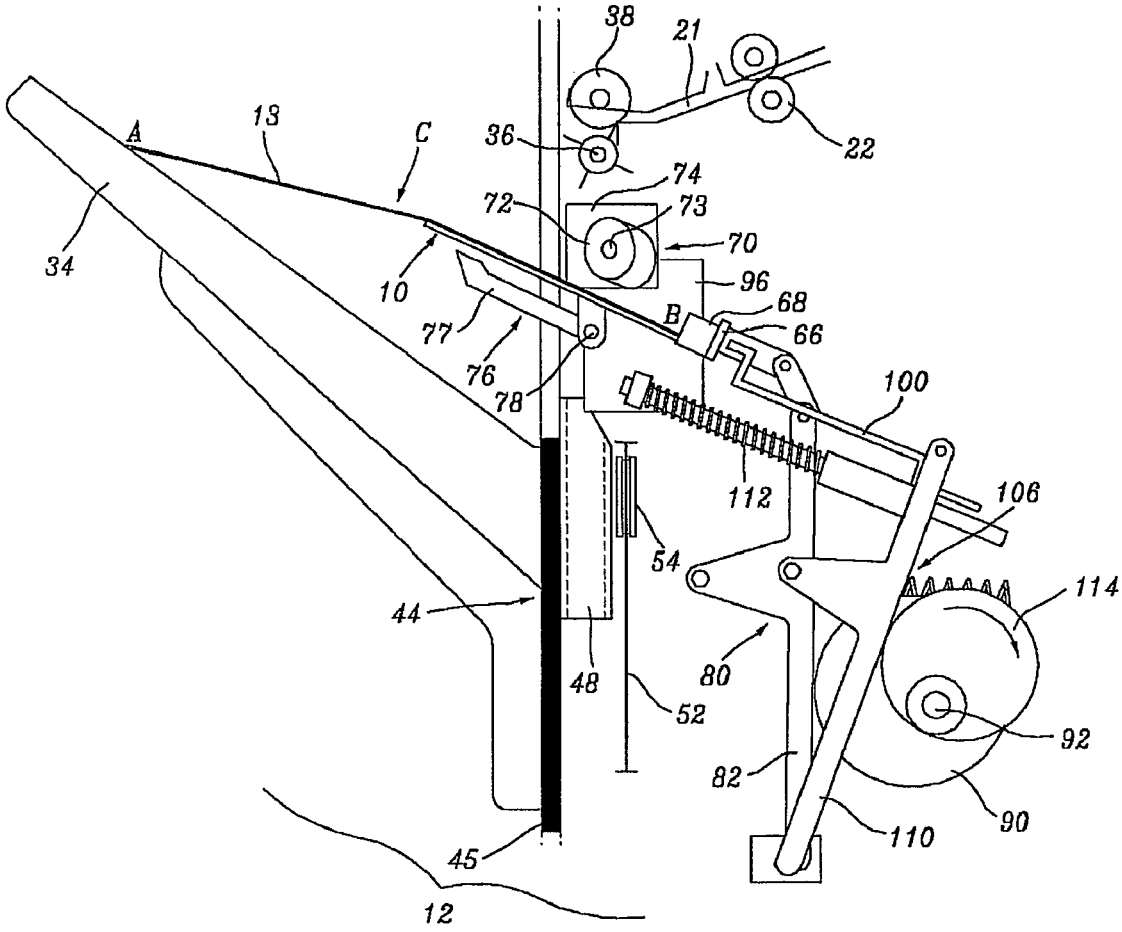

Reference will now be made in detail to the preferred embodiments of the present invention, examples of which are illustrated in the accompanying drawings.

A finishing apparatus in a copying machine according to the present invention includes a jogging assembly 170 aligning papers in left and right directions, a paper contact plate 166, a paper roller 200 pushing the papers set in the paper contact plate 166 to a paper stacker 134, a tray base 10 moving in a direction opposite to the paper roller to guide alignment of a set of the papers, and an angle adjusting unit provided in the tray base.

The angle adjusting unit includes a support roller 130 supporting the tray base to move the tray base and a recess groove 131 formed at a predetermined position on the tray base to recess the support roller.

The tray base 10 is connected with one end of a rotational link 210 to reciprocate along the contact plate 166, and the other end of the rotational link is fixed to a fixed shaft 150 so that a gear 125 provided to form a single body with the rotational link is engaged with a driving motor gear 110.

The rotational link 210 is linked to a paper clamp unit 177 that pushes the papers stacked onto the paper stacker at a position where the tray base 10 moves to the paper stacker 134 while is detached from the paper stacker to be retracted to the paper contact plate at a position where the tray base 10 is retracted to the paper contact plate 166.

A paddle (hereinafter referred to as a rolling wheel) 136 that guides the papers to the paper contact plate 166 is provided on the jogging assembly 170.

The paper stacker 134 is provided to move up and down.

The finishing apparatus in a copying machine according to the present invention will be described in more detail with reference to FIGS. 6 to 10.

The related art structure can be applied to the finishing apparatus in a copying machine according to the present invention within the range that it does not depart from an object of the present invention.

The description of the same technical structure as that of the related art finishing apparatus will be omitted and a tray unit which is a main feature of the present invention will be described in detail.

Figure 7A:
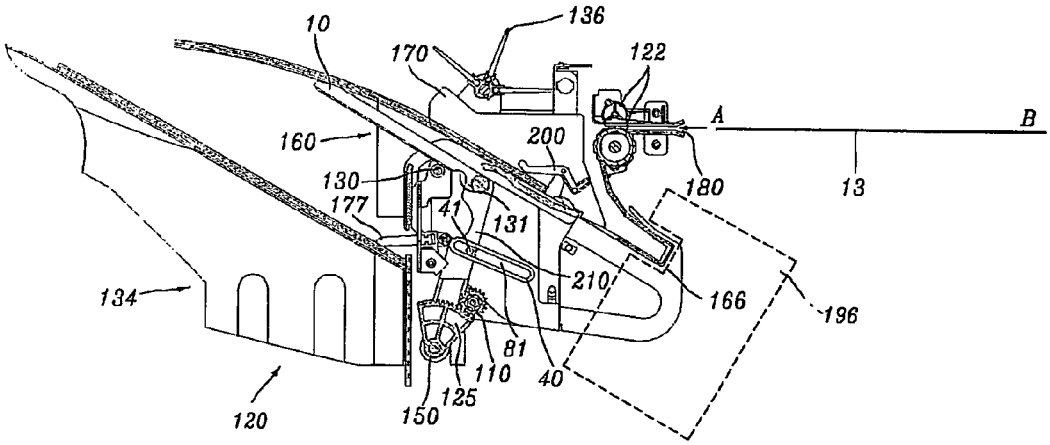
FIGS. 7*a* to 7*c* are sectional views illustrating the operation of the finishing apparatus according to the present invention.

As shown in FIG. 7*a*, a tray unit 160 of the present invention is provided in such a manner that papers 13 are fed from the copying machine to the tray unit 160 through a paper path network 180, are subject to the finishing process such as stapling, and are stacked onto a paper stacker 134. The paper stacker 134 can be provided by the related art, which moves up and down with respect to the tray unit 160 and is shifted to a side to enable reciprocation.

The tray unit 160 is provided with a pair of paper conveying rollers 122. The papers 13 are fed through an outlet formed by the paper conveying rollers 122 and then move to a tray base 10 through a rolling wheel 136 provided on the paper stacker. The tray base 10 guides the papers 13 to the paper contact plate 166.

Since the tray base 10 is tilted at a predetermined angle, the papers 13 moved from the first part "A" are slid along the surface of the tray base so that the second part "B" moves to the paper contact plate 166.

Figure 6:
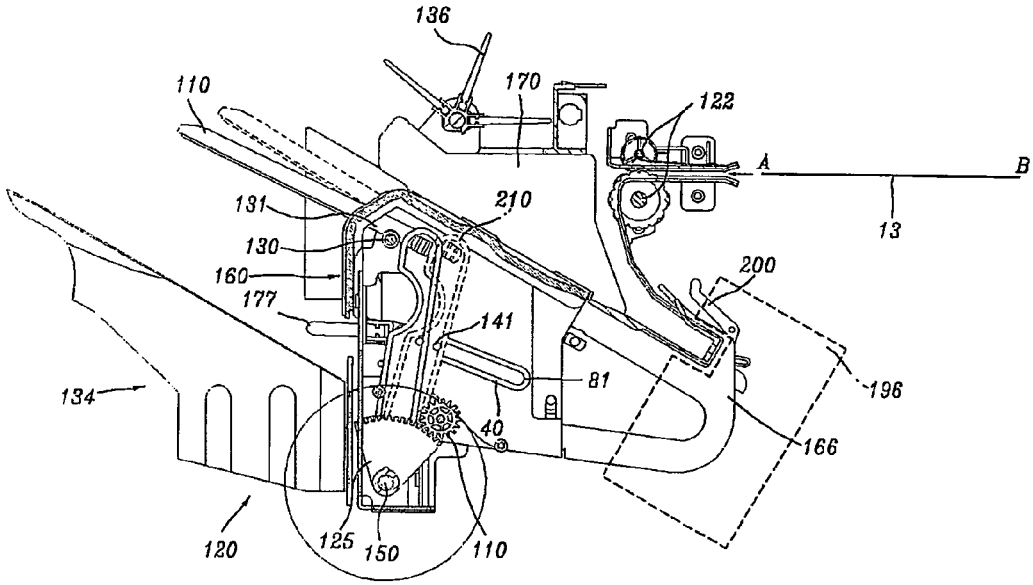
FIG. 6 is a sectional view illustrating a structure of a finishing apparatus according to the present invention.
Figure 10:
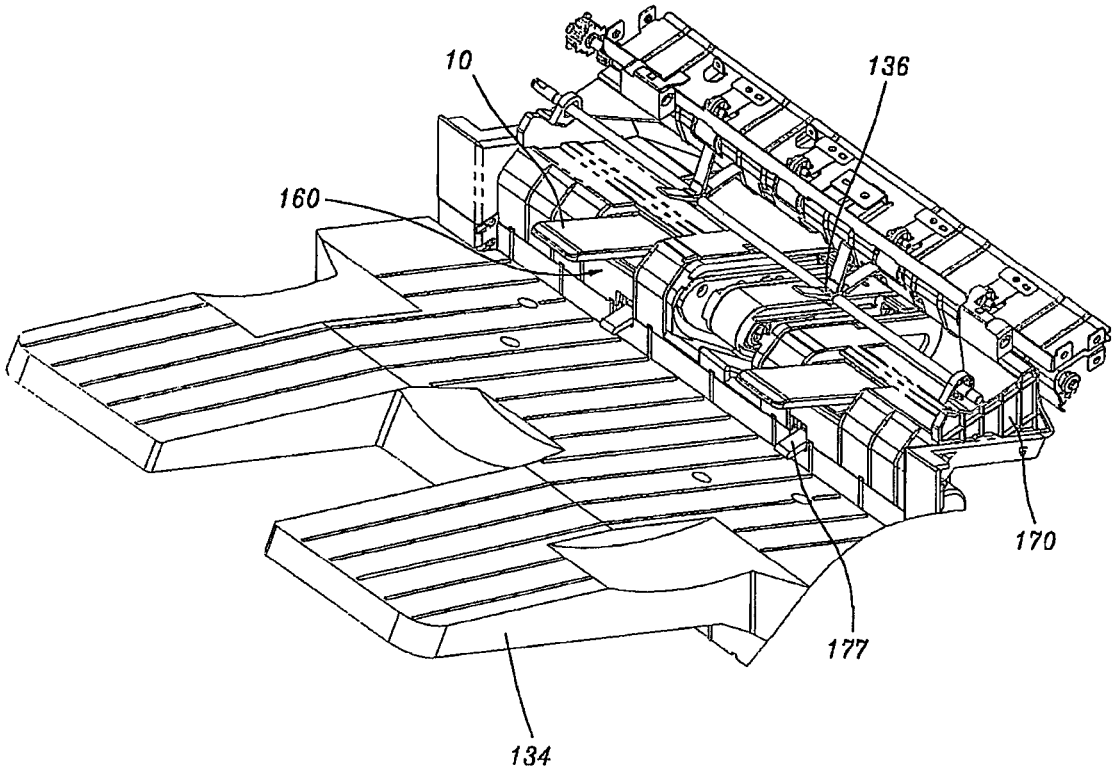
FIG. 10 is a perspective view illustrating the main part of the finishing apparatus according to the present invention.

The width of the papers 13 aligned on the paper contact plate, as shown in FIGS. 6 and 10, is defined by driving a jogging assembly 170. The jogging assembly 170 is driven by a motor (not shown).

As shown in FIG. 7*a*, if a predetermined number of papers 13 are aligned on the paper contact plate 166, a stapler 196 provided at the rear end of the paper contact plate 166 staples the corners of the papers. A plurality of staplers may be provided.

Figure 7B:
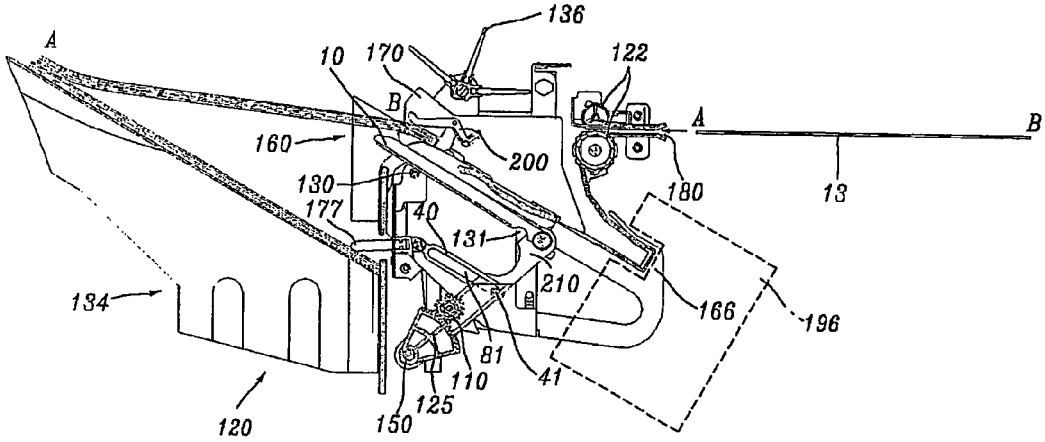

The papers stapled by the stapler, as shown in FIG. 7*b*, move to the outer end of the tray base 10 by allowing a paper roller 200 to push the second part "B" of the papers. At the same time, the tray base 10 is retracted to the paper contact plate so as not to prevent the papers from being stacked onto the paper stacker 134.

Meanwhile, a clamp unit 177 is provided to prevent the papers stacked onto the paper stacker from being misaligned by being in contact with papers moving for the finishing process. The clamp unit 177 is driven in a state where it is linked to the tray base 10.

Figure 7C:
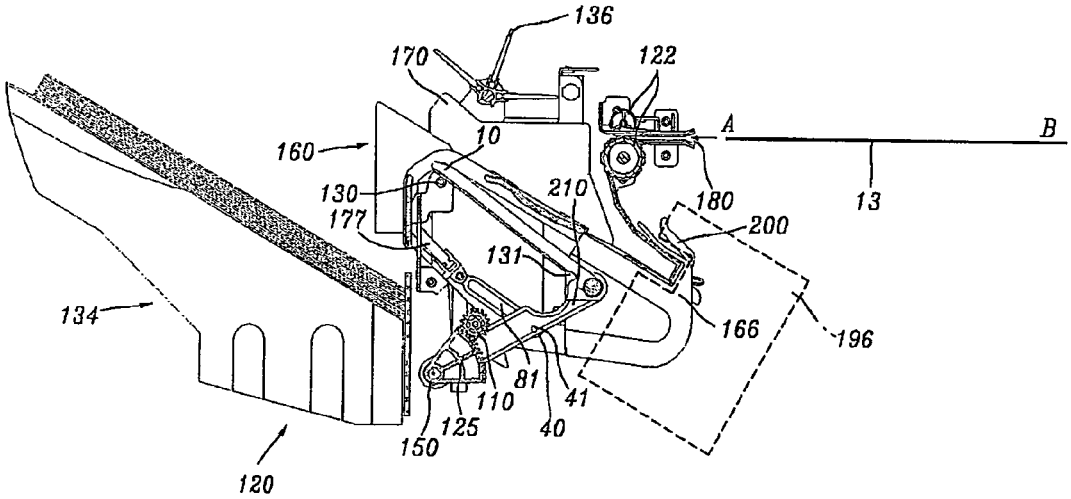
Figure 8:
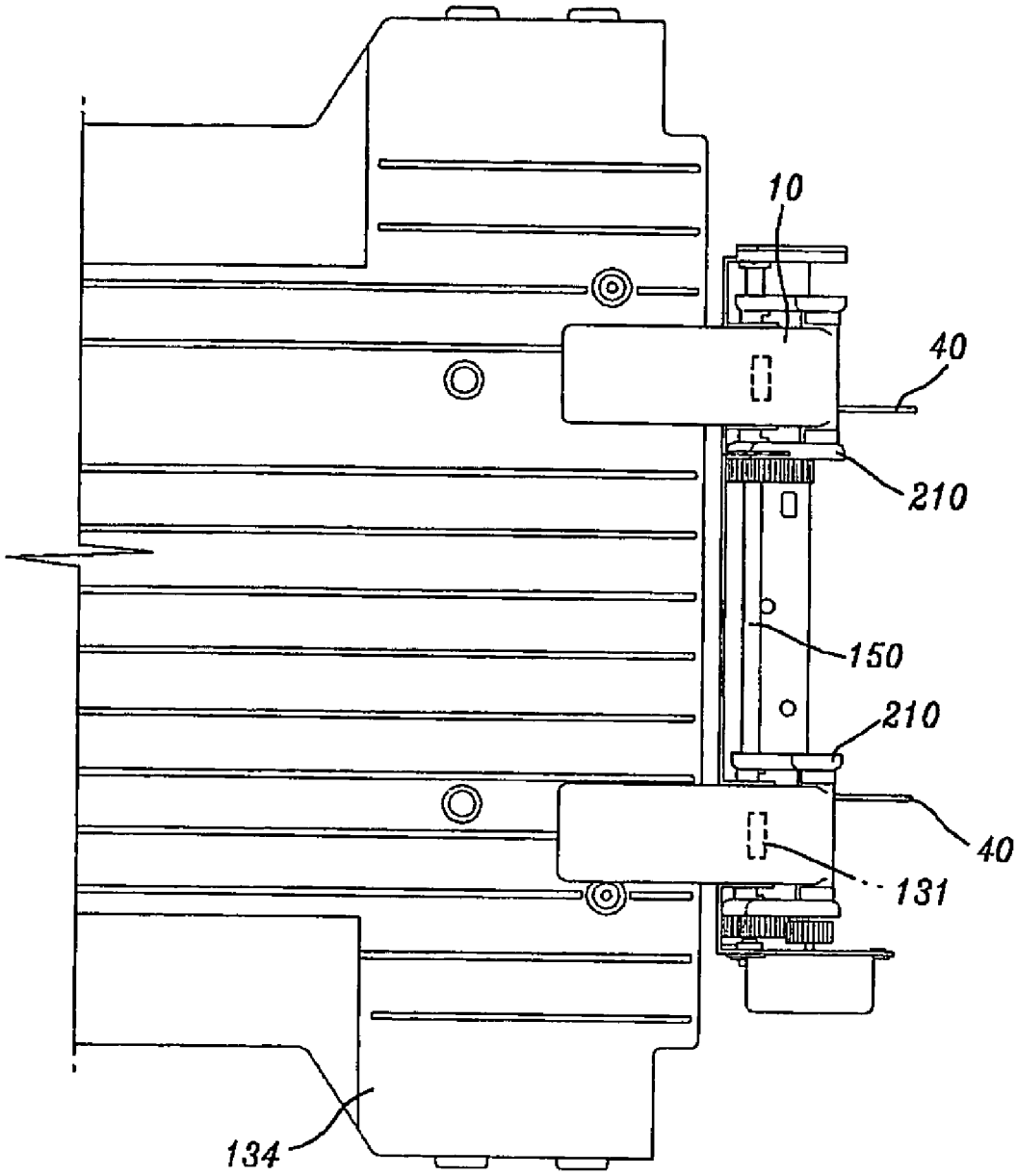
FIG. 8 is a plane view illustrating a main part of the finishing apparatus according to the present invention.
Figure 9:
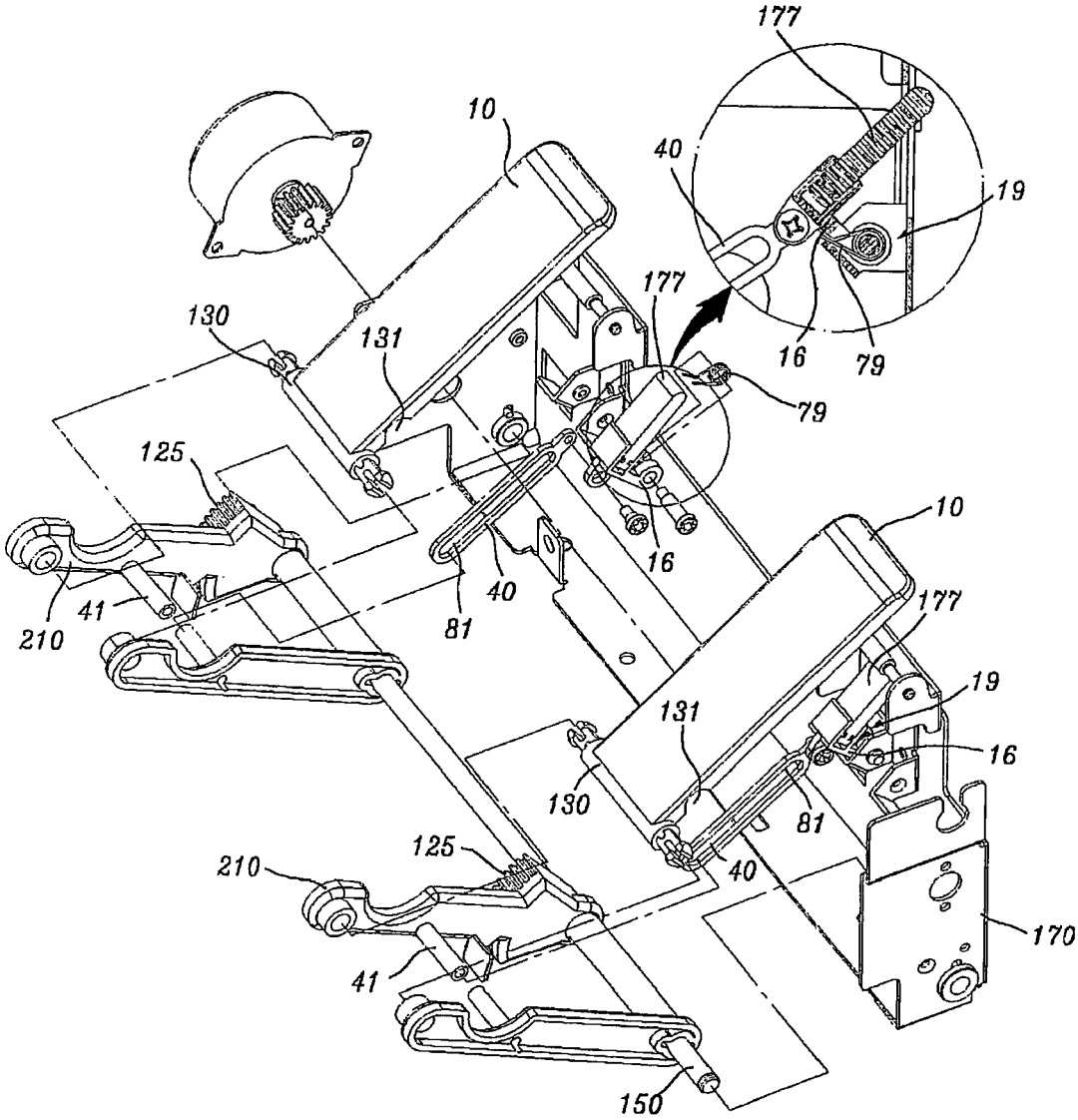
FIG. 9 is an exploded perspective view illustrating the main part of the finishing apparatus according to the present invention.

As shown in FIG. 7*a*, in a state where the tray base 10 is outwardly extended to guide the papers fed from the paper conveying rollers 122 to the paper contact plate 166 to perform the finishing process, the clamp unit 177 pushes the papers stacked onto the paper stacker 134. As shown in FIG. 7*c*, when the finished papers (stapled papers) are stacked onto the paper stacker 134 by pushing them from the paper contact plate 166, i.e., when the tray base 10 is retracted, the clamp unit 177 is retracted together so as not to prevent the papers from being stacked onto the paper stacker 134.

Preferably, the clamp unit 177 is temporarily retracted before the papers are dropped onto the paper stacker 134 so that it pushes the papers stacked onto the paper stacker 134 for a long time if possible.

In other words, as shown in FIG. 7*b*, even if the tray base 10 is retracted, the clamp unit pushes the papers until the papers are dropped onto the paper stacker and moves at the time when the papers are dropped onto the paper stacker so as not to prevent the papers from being stacked onto the paper stacker.

Particularly, the tray base 10 includes an angle adjusting unit that can adjust an angle depending on the size of the papers.

The angle adjusting unit of the tray base will be described in more detail with reference to FIGS. 6, 8, 9, and 10.

The angle adjusting unit of the tray base is provided in such a manner that the tray base 10 moves along a support roller 130. The angle adjusting unit includes a recess groove 131 recessed with a predetermined depth at a predetermined position of the tray base which is in contact with the support roller 130.

The tray base provided with the recess groove 131 reciprocates along the paper contact plate 166 by means of a rotational link 210. The rotational link 210 rotates clockwise or counterclockwise around a fixed shaft 150. A gear 125 is provided in the rotational link 210 to form a single body with the rotational link 210. The gear 125 is engaged with a driving motor gear 110 of a driving motor (not shown) to reciprocate the rotational link 210 at a predetermined angle.

Meanwhile, the clamp unit 177 is fixed to a clamp unit support 19 provided in the tray unit. The clamp unit support 19 is fitted into a support shaft 16 in a state where the end of the clamp unit 177 is elastically supported toward the paper stacker 134 by a spring 79.

The support shaft 16 is interposed between a clamp unit driving ring 40 and the clamp unit 177 and movably supports the clamp unit 177 and the clamp unit driving ring 40. The clamp unit driving ring 40 has a linear type ring shape and is fitted into an extension 41 formed at a middle part of the rotational link 210.

In a state where the rotational link 210 rotates clockwise so as not to completely retract the tray base 10, the extension 41 freely moves around a slit groove 81 in the driving ring 40 so as not to retract the clamp unit 177. However, in a state where the rotational link 210 is retracted, the end of the driving ring 40 is caught in the extension 41. For this reason, the driving ring 40 moves downwardly so that the clamp unit 177 fixed to the support shaft 16 is retracted downwardly.

If the rotational link 210 rotates counterclockwise to guide the papers moving through the paper conveying rollers to the paper contact plate 166, the tray base 10 moves upwardly (toward the paper stacker). The clamp unit 177 returns to the original position by means of action of the spring 79 provided in the clamp unit support.

The clamp unit returned to the original position pushes again the papers stacked onto the paper stacker 134.

In the present invention, when the rotational link rotates counterclockwise to extend the tray base 10 to the paper stacker, the support roller 130 is recessed in the recess groove 131 formed below the tray base so that the tray base is dropped by a predetermined distance. Thus, the distance between the outer end of the tray base 10 and the surface of the paper stacker 134 is reduced.

The angle adjusting unit of the tray base 10 according to the present invention is driven so as not to change the angle of the tray base by allowing the recess groove 131 not to be positioned in the support roller 130 if small sized papers moves to the tray base through the paper conveying roller.

Meanwhile, if large sized papers move to the tray base through the paper conveying roller, the angle adjusting unit is driven to position the recess groove 131 in the support roller 130, thereby dropping the end of the tray base by a predetermined distance.

As described above, the angle adjustment of the tray base is made depending on the size of the papers. Therefore, when the large sized papers are guided to the contact plate, the papers are smoothly slid to the contact plate by allowing the surfaces of the papers arranged in the paper stacker 134 and the tray unit 160 not to be folded. When the small sized papers are guided to the contact plate, the papers are smoothly slid to the contact plate by tilting the tray base.

At the position of the rotational link 210 and the tray base 10 marked by a dotted line of FIG. 6, the small sized papers are guided. At the position of the rotational link 210 and the tray base 10 marked by a solid line of FIG. 6, the large sized papers are guided.

It is apparent that the angle adjusting unit of the tray base according to the present invention can be driven by the controller, the driving gear, and the sensor described in the related art in combination. Moreover, any modification may be made to the structure of the angle adjusting unit of the tray base according to the present invention for use in various printing apparatuses such as a digital printer in addition to the copying machine.

Furthermore, while the two-stage angle of the tray base has been described in the present invention, its three-stage or four-stage angle can be made to the tray base by additionally providing the tray base with a separate extension which is in contact with the support roller.

INDUSTRIAL APPLICABILITY

As aforementioned, the finishing apparatus according to the present invention has the following advantages.

The finishing apparatus, as shown in FIG. 6, includes a jogging assembly 170 aligning papers in left and right directions, a stapler 196, a paper contact plate 166, a paper roller 200 pushing the papers to a paper stacker 134, ends of the papers being positioned in the stapler, and a tray base 10 moving in a direction opposite to the paper roller to guide alignment of a set of the papers. Particularly, since the tray base is provided with the angle adjusting unit that guides the papers by varying the angle of the tray base depending on the size of the papers, the large sized papers can be finished without enlarging the size of the tray base. In addition, since the size of the tray base is not enlarged, the reciprocating time of the tray base can be reduced, thereby improving finishing efficiency of the papers.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A finishing apparatus in a copying machine comprising:

a jogging assembly aligning papers in left and right directions;

a paper contact plate;

a paper pushing device adjacent to the paper contact plate, the paper pushing device being structured to push the papers set in the paper contact plate to a paper stacker;

a tray base in mechanical communication with a driving mechanism which moves the tray base in a direction opposite to the paper pushing device to guide alignment of a set of the papers;

a recess groove provided in the tray base; and an angle adjusting unit provided in the tray base to adjust an angle of the tray base, the angle adjusting unit comprises a support roller which supports the tray base at a first angle and contacts the recess groove to adjust the tray base to a second angle, different from the first angle, wherein the tray base has one end connected with one end of a rotational link to reciprocate along the paper contact plate, and the other end of the rotational link is fixed to a fixed shaft and rotates at a predetermined angle around the fixed shaft.

2. The finishing apparatus in a copying machine according to claim 1, wherein the support roller supports the tray base and the recess groove is formed at a predetermined position on the tray base to recess the support roller.

3. The finishing apparatus in a copying machine according to claim 1, wherein the rotational link is linked to a paper clamp unit that pushes the papers stacked onto the paper stacker at a position where the tray base moves to the paper stacker while is detached from the paper stacker to the paper contact plate at a position where the tray base is retracted to the paper contact plate.

4. The finishing apparatus in a copying machine according to claim 1, further comprising a paddle that guides the papers to the paper contact plate.

5. The finishing apparatus in a copying machine according to claim 1, wherein a paper stacker is provided to move up and down.

6. The finishing apparatus in a copying machine according to claim 1, further comprising at least one stapler that staples the papers set in the paper contact plate before pushing them to the paper stacker.

7. The finishing apparatus in a copying machine according to claim 1, wherein the driving mechanism includes at least the rotational link.

8. The finishing apparatus in a copying machine according to claim 7, further comprising a clamp unit fixed to a clamp unit support provided in a tray unit of the tray base.

9. The finishing apparatus in a copying machine according to claim 8, wherein when the rotational link rotates counterclockwise to guide papers moving through paper conveying rollers to the paper contact plate, the tray base moves upwardly toward the paper stacker and the clamp unit returns to an original position by action of a spring provided in the clamp unit support.

10. The finishing apparatus in a copying machine according to claim 8, wherein the clamp unit support is fitted into a support shaft in a state where an end of the clamp unit is elastically supported toward the paper stacker by a spring.

11. The finishing apparatus in a copying machine according to claim 10, wherein the support shaft is interposed between a clamp unit driving ring and the clamp unit and movably supports the clamp unit and the clamp unit driving ring.

12. The finishing apparatus in a copying machine according to claim 11, wherein the clamp unit driving ring has a linear ring shape and is fitted into an extension formed at a middle part of the rotational link.

13. The finishing apparatus in a copying machine according to claim 12, wherein the rotational link rotates to retract and extend the tray base.

14. The finishing apparatus in a copying machine according to claim 12, wherein the extension freely moves around a slit groove in the clamp unit driving ring so as not to retract the clamp unit.

15. The finishing apparatus in a copying machine according to claim 12, wherein in a state where the rotational link is retracted, the end of the clamp unit driving ring is caught in the extension.

16. A finishing apparatus in a copying machine comprising:

a jogging assembly aligning papers in left and right directions;

a paper contact plate;

a paper pushing device adjacent to the paper contact plate, the paper pushing device being structured to push the papers set in the paper contact plate to a paper stacker;

a tray base in mechanical communication with a driving mechanism which moves the tray base in a direction opposite to the paper pushing device to guide alignment of a set of the papers;

a recess groove provided in the tray base; and an angle adjusting unit provided in the tray base to adjust an angle of the tray base, the angle adjusting unit comprises a support roller which supports the tray base at a first angle and contacts the recess groove to adjust the tray base to a second angle, different from the first angle, wherein the tray base reciprocates along the paper contact plate.

17. A finishing apparatus in a copying machine comprising:

a jogging assembly aligning papers in left and right directions;

a paper contact plate;

a paper pushing device adjacent to the paper contact plate, the paper pushing device being structured to push the papers set in the paper contact plate to a paper stacker;

a tray base in mechanical communication with a driving mechanism which moves the tray base in a direction opposite to the paper pushing device to guide alignment of a set of the papers;

a recess groove provided in the tray base;

an angle adjusting unit provided in the tray base to adjust an angle of the tray base, the angle adjusting unit comprises a support roller which supports the tray base at a first angle and contacts the recess groove to adjust the tray base to a second angle, different from the first angle, wherein:

the driving mechanism includes at least a rotational link;

the driving mechanism further includes a fixed shaft, a gear and a driving motor gear;

the rotational link rotates clockwise or counterclockwise around the fixed shaft;

the gear is provided in the rotational link to form a single body with the rotational link; and the gear is engaged with the driving motor gear to reciprocate the rotational link at a predetermined angle.

* * * * *